United States Patent [19]

McClusky et al.

[11] Patent Number: 4,987,727

[45] Date of Patent: Jan. 29, 1991

[54] APPARATUS FOR PACKAGING CITRUS FRUIT

[75] Inventors: Stanley McClusky; Jerry L. Boyd, both of Bakersfield, Calif.

[73] Assignee: McClusky Machinery Sales & Service, Edison, Calif.

[21] Appl. No.: 464,199

[22] Filed: Jan. 12, 1990

Related U.S. Application Data

[62] Division of Ser. No. 260,437, Oct. 22, 1989, Pat. No. 4,907,396.

[51] Int. Cl.[5] ..... B65B 1/22; B65B 1/24; B65B 25/04

[52] U.S. Cl. ..... 53/525; 53/526

[58] Field of Search ..... 53/525, 526, 527, 528, 53/530, 437, 439, 436, 449, 171

[56] References Cited

U.S. PATENT DOCUMENTS

| | | | |
|---|---|---|---|
| 1,867,538 | 7/1932 | Labombarde | 53/526 |
| 3,344,579 | 10/1967 | Gentry et al. | 53/525 |
| 3,475,877 | 11/1969 | Fuller et al. | 53/525 X |
| 3,566,579 | 3/1971 | Russell | 53/525 X |
| 3,735,552 | 5/1973 | Derderian | 53/525 X |
| 4,002,008 | 1/1977 | Grasson | 53/527 X |
| 4,565,050 | 1/1986 | Norris | 53/525 X |

*Primary Examiner*—James F. Coan

*Attorney, Agent, or Firm*—Poms, Smith, Lande & Rose

[57] ABSTRACT

An appartus and method for packaging citrus fruit or discrete articles in a tightly packed pattern or arrangement closely resembling that of a hand packed box. A two-part telescoped box is conveyed in inverted position to a box filling and counting station, the box including an box inner part in which the side and end flaps are in open relation at the box filling station. At the counting station, fruit is being oscillated transversely of their path of travel so as to singulate the fruit into a plurality of counting stations arranged in a row and in a valley. When the row count has been satisfied, all of the fruit in the row are lifted upwardly for discharge into the open box. When the full count is satisfied, the filled box with fruit extending above the top of the outer box is moved to a box handling station in which the inner box is lifted to a height where the side and end flaps of the inner box may be folded over the top fruit. The box is then conveyed into a box vibrating and pressure applying station in which the box is conveyed through a passageway which slowly decreases in height from its entrance to its exit end. In travel of the box along this passageway, the sides of the box are held by moving side conveyors, the bottom of the box contacts a bottom conveyor and the side and end flaps which have been folded over are brought into contact with a top belt conveyor which progressively increases pressure against the closed inner box part. When the box exits the vibratory and pressure applying station, the box enters a box invertor in which the box is turned 180° in order to present the outer box on top, which when removed, discloses a top layer of fruit arranged in uniform closely spaced rows.

9 Claims, 8 Drawing Sheets

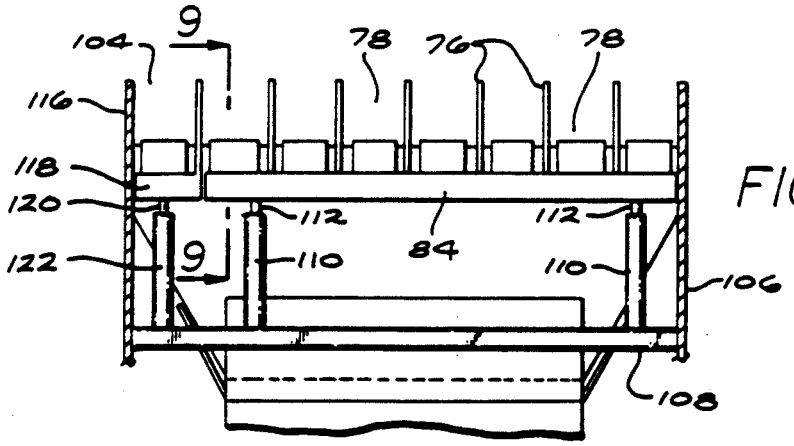
FIG. 8
FIG. 9
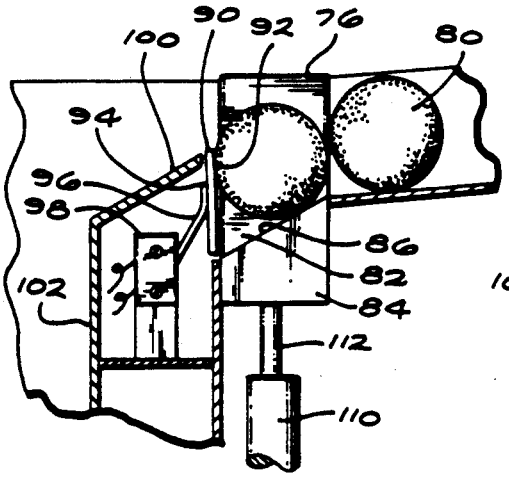
FIG. 10
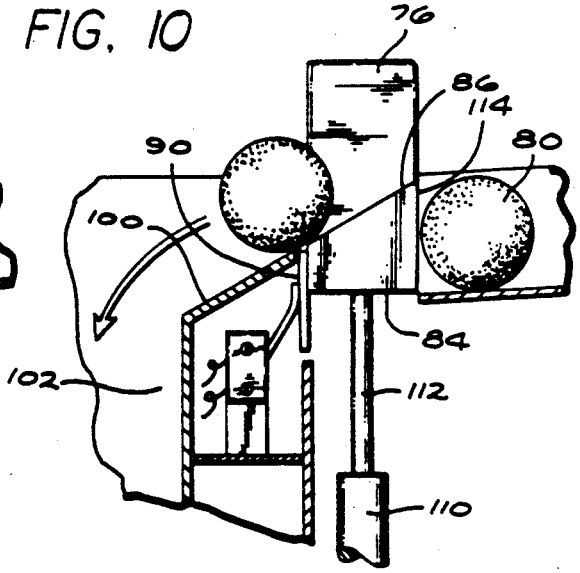
FIG. 11
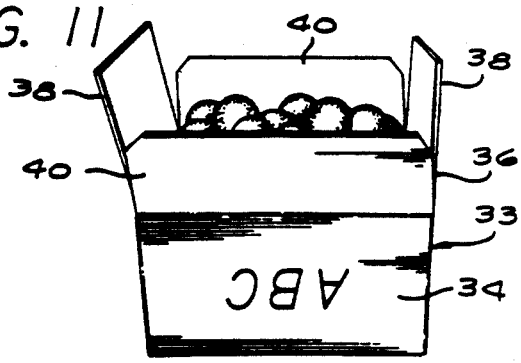
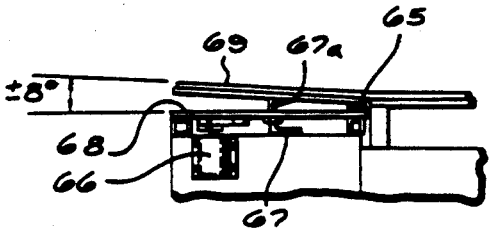
FIG. 7a

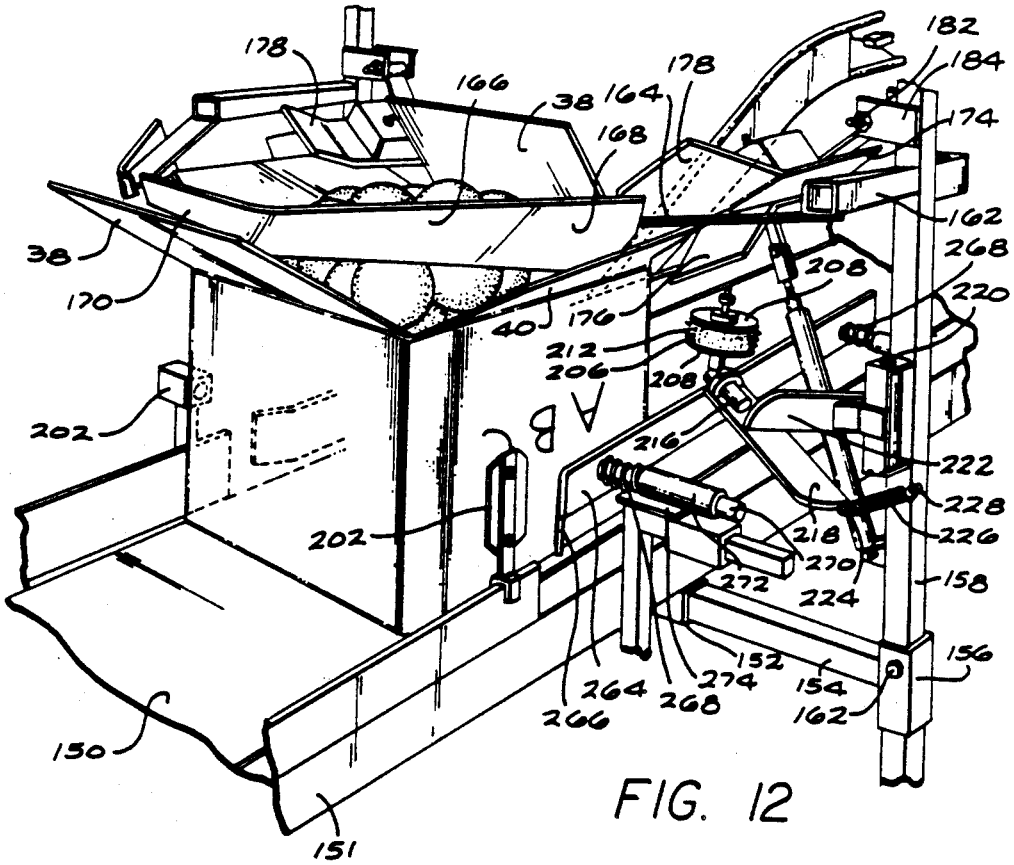
FIG. 12
FIG. 13
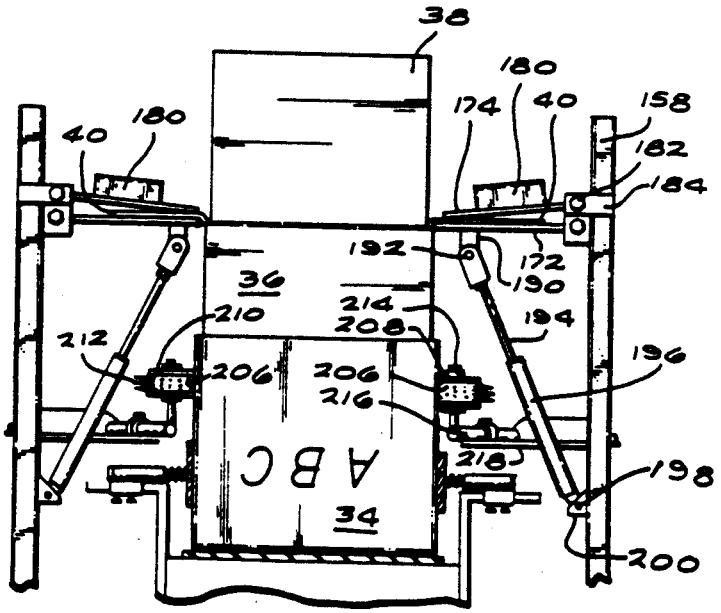

FIG. 20
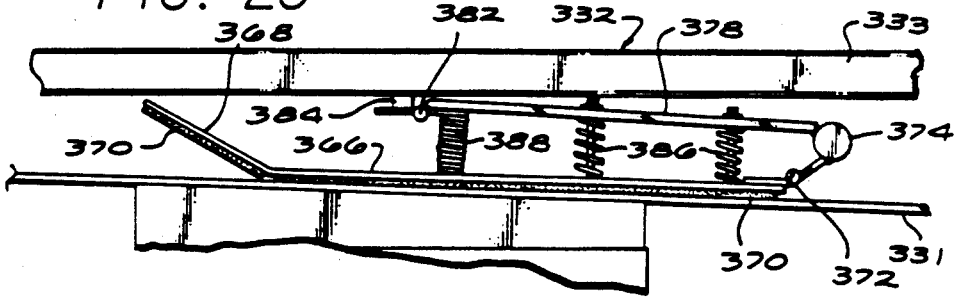
FIG. 21
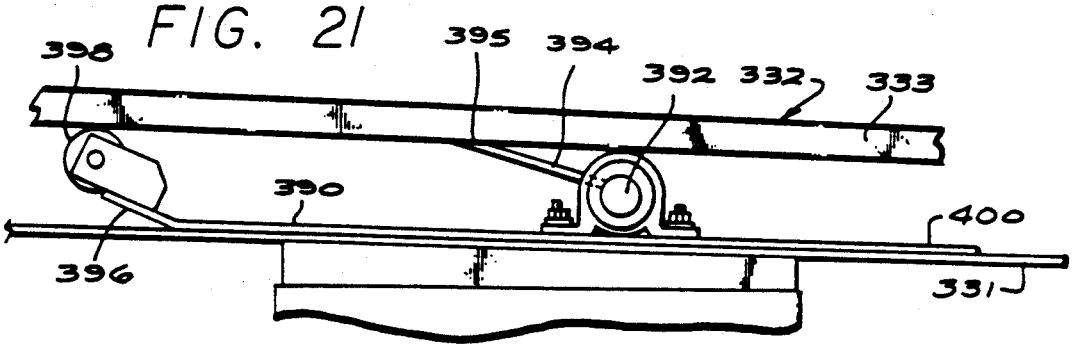
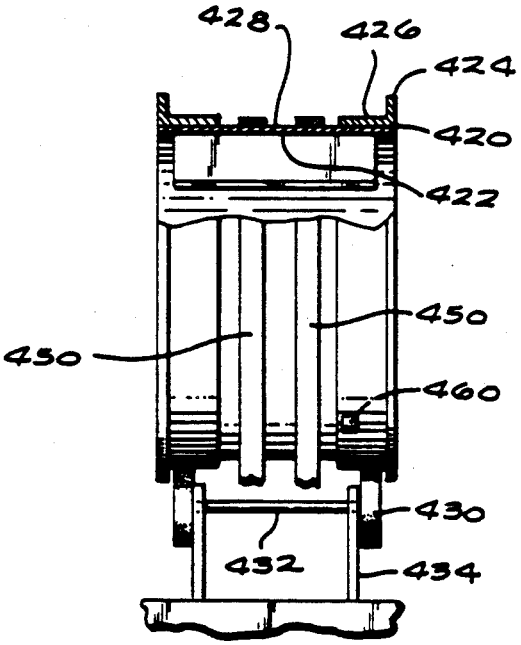
FIG. 22
FIG. 23
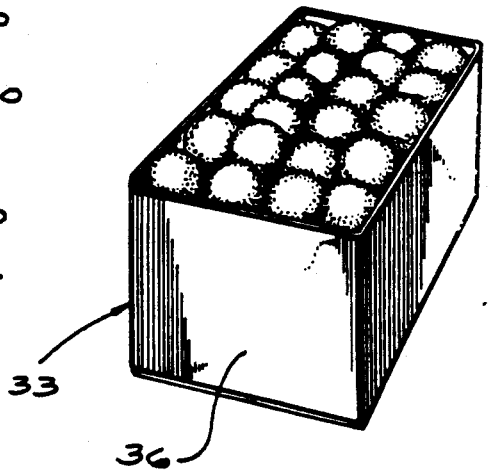

FIG. 14
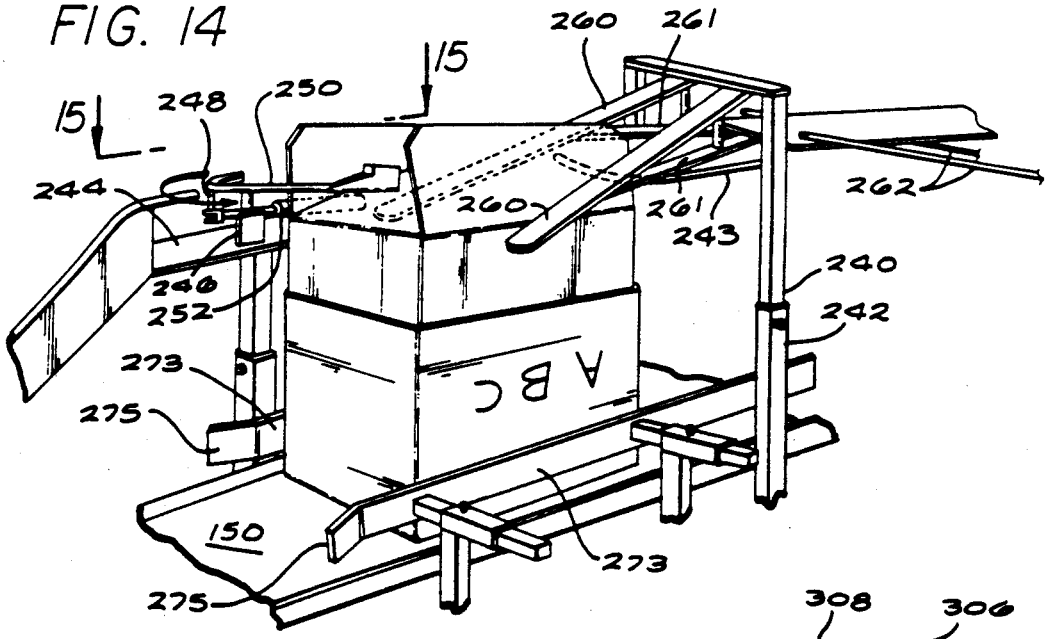
FIG. 18
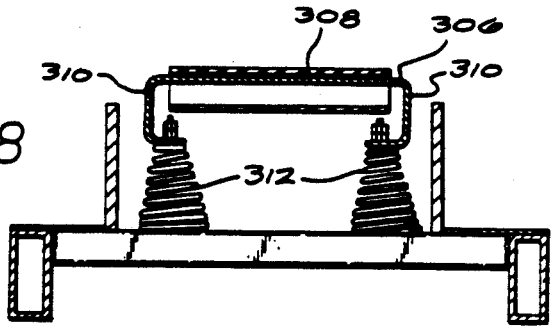
FIG. 16
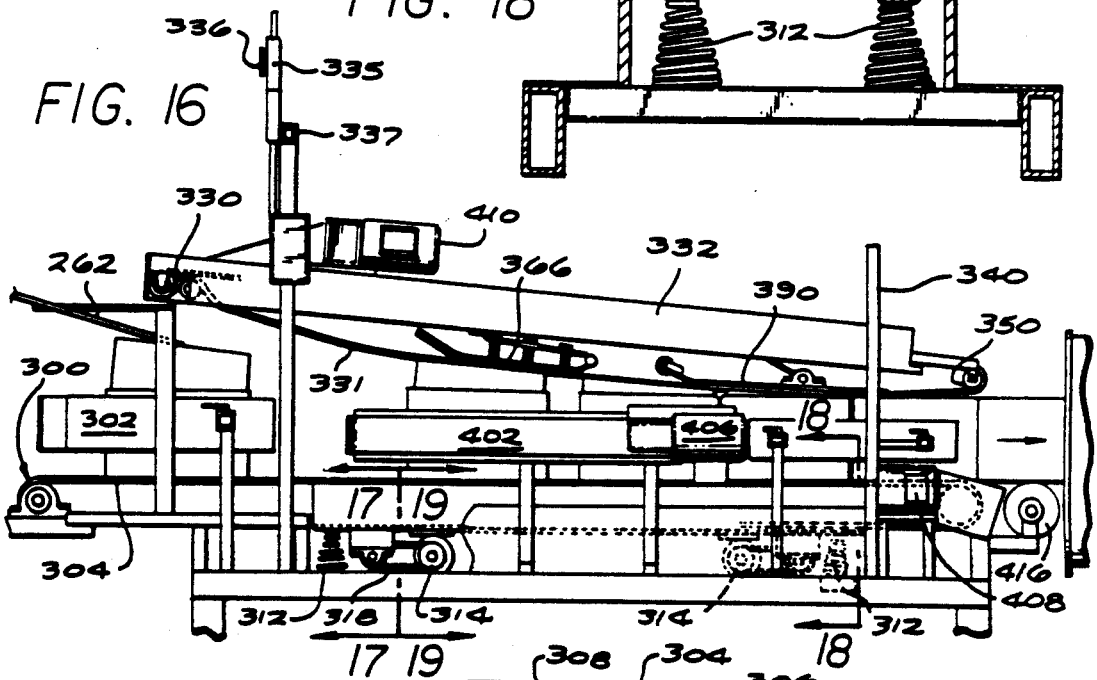
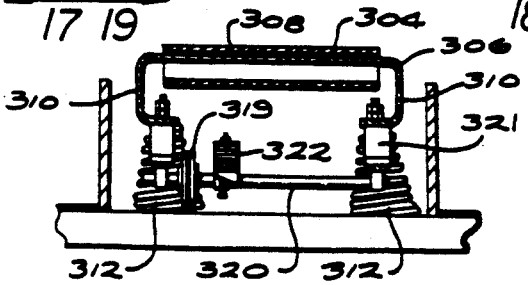
FIG. 17

APPARATUS FOR PACKAGING CITRUS FRUIT

This application is a division, of application Ser. No. 07/260,437, filed Oct. 22, 1989 now U.S. Pat. No. 4,907,396.

BACKGROUND OF THE INVENTION

The present invention contemplates a method and apparatus for filling boxes or receptacles with discrete articles such as fruit in which a selected number of fruit are counted and fill the box. The invention contemplates a novel method and apparatus in which the box may be rapidly filled and the fruit subjected to vibration with side and end flaps of an inside box part in closed relation so that during vibrations part of the box may be continuously advanced and pressure applied to the closed side and end flaps of the inner box part to push the inner box part downwardly into the outer box part and to apply progressively increasing vertical pressure to the vibrated fruit through the closed upper end of the inner box part.

Prior proposed apparatuses and methods for filling a box of a selected volume and size with discrete fruit or articles have included hand packing the fruit in the box by arranging the fruit in layer patterns which were predetermined according to the size and number of the fruit required to fill such a box. Such hand packed boxes required skilled packers to rapidly arrange the fruit in the predetermined layer patterns and to maintain over many packing hours a suitable packing rate. Such hand packed filled boxes were usually boxes of a standard size and volume.

Other prior proposed apparatuses for packaging a selected number of fruit in a box have included the use of individual suction cups for individual placement of fruit in a box in accordance with a prearranged selected pattern. The suction cup method simulated the hand packing method because each fruit was individually placed in the box. Such a method of packing the box was also time consuming.

Other prior proposed methods of packaging fruit in a box have included feeding the fruit into the box by a vertically disposed fruit conveyor in which the box was raised to a box receiving position with respect to the fruit conveyor and then as the fruit was successively deposited in the box, the box was lowered step by step to receive additional fruit. See U.S. Pat. No. 2,061,490.

In still another prior proposed construction, a bucket type elevator transferred and lowered fruit into the box and then was progressively raised as the level of articles deposited therein increased. See U.S. Pat. No. 2,889,676. In still another prior proposed construction for filling boxes with discrete articles, a box was raised so that the bottom end of a vertically disposed bucket conveyor could deposit articles in the bottom of the box, the box being progressively lowered as the box was gradually filled. See. U.S. Pat. No. 3,618,285.

In a still further prior proposed construction for filling boxes with citrus fruit, a box which may have been filled by any one of the prior methods, except hand packing, described above was placed in a vibrating station with the box top open and as the box was vibrated at a certain frequency a vertically movable platen was lowered to apply pressure to the top layer of fruit and at a frequency of the same amplitude and phase as that of the vibrated box so as to facilitate movement of the fruit into the desired tightly packed pattern or arrangement. See U.S. Pat. No. 3,566,579.

In some of the prior proposed apparatuses, the box is vibrated while the box is being filled. Under these conditions, the fruit has difficulty making a tight pack and the box is usually of a larger size and volume than a standard size box which would have been hand packed. The additional cost of a larger volume box may be only from four to six cents per box, but in view of the thousands of boxes packaged the savings of four to six cents per box and utilizing a standard size box is substantial to the packing house. Moreover, the packing house does not need to carry two different sized boxes in inventory. The present invention contemplates packaging with a standard size box.

SUMMARY OF INVENTION

The present invention contemplates an apparatus and method for packaging citrus fruit wherein a novel filling and counting station fills a box to a preselected count of fruit, a box handling station manipulates the two part box whereby an inner box part is lifted while the outer box part is restrained against upward movement during the lifting and open end and side flaps of the inner box part are infolded to substantially closed position, and a three stage vibrating and pressure applying and box closing station receives the box and first subjects the fruit to vibration to place the fruit in a fluid-like state, then applies opposing resilient forces to initiate closing of the inner box into the outer box, and then firmly closes the inner box relative to the outer box with the end flaps in fully closed position. Since the box before filling was inverted, the closed box received from the vibrating and closing station enters an inverting station where the box is turned 180° so that the two part box is ready for final sealing and distribution.

The present invention more particularly relates to a novel method and apparatus so constructed and arranged that fruit may be introduced into an inverted two part box in a row and in random arrangement with the selected number of fruit exceeding the normal height of the box and extending into a top box opening as defined by upwardly extending end and side flaps of an inner box part. The invention contemplates lifting the inner box part upwardly to a position where the side and end flaps of the inner box part may be moved into closed relation above the top layer of fruit. After the box flaps are in closed relation, the box is advanced along a conveyor and subjected to vertical and lateral vibratory motion during which the top of the box, passes beneath a pressure applying means which progressively in two stages applies downward pressure to the box flaps and inner box parts. As the fruit is in a fluid state because of vibratory impulses imparted thereto, the inner box part may be pressed downwardly until it reaches its normal closed relation with the outer box part. During this movement the pressure applied to the fruit in motion through the folded closed flaps causes the fruit to seek and to obtain a tightly packed relation similar to a hand packed arrangement. The packing means of the invention provides continuous movement of a plurality of boxes along a substantially continuous moving conveyor and as a result, the boxes may be rapidly filled, rapidly closed and rapidly subjected to vibrations which move the fruit in the boxes into a desired final pattern. The boxes may then be turned 180° or inverted so that the outer box part lies on top and, if desired, may be removed to show the selected pattern arrangement of the top layer of fruit within the inner box part.

The object of the present invention, therefore, is to provide a novel apparatus and method for packaging a selected number of articles such as fruit in a box of selected size and volume.

An object of the present invention is to provide an apparatus in which the fruit are counted in a row in a novel manner and the counted fruit in a row are simultaneously released from the counting station into a box to be filled.

Another object of the invention is to disclose and provide a counting station for counting discrete articles such as fruit in which the counting station includes a row of counting stalls and in which an oscillating delivery apron is provided for simulating the articles for entry into the counting stalls.

Another object of the invention is to provide a counting station in which articles are counted in a row and in which a single count stall is provided for obtaining a precise article count.

Another object of the invention is to disclose an apparatus for packaging citrus fruit in which a novel counting station is provided and in which a box filled with the selected counted fruit and having upwardly extending box flaps is conveyed along a selected path where the upstanding flaps are folded into closed relation in a novel manner.

Another object of the invention is to provide an article packaging machine in which a two part box is used and wherein an inner box part is lifted and raised to a position where the inner box flaps may be folded into closed position.

Another object of the invention is to provide a box handling station for receiving a filled box with inner and outer box parts in fully telescoped relation and wherein the inner .box part is lifted out of such relation to a position where the end and side flaps thereof may be closed.

Another object of the invention is to provide a box handling station wherein means are provided for restraining the outer box part while the inner box part is lifted as described above.

A still further object of the invention is to provide in such a box handling station means by which the end flaps of the inner box part are inturned towards closed position and then the side flaps are inturned to closed position over the end flaps.

A still further object of the present invention is to provide a means for vibrating a filled and closed box received from the box handling station and applying first resilient pressure to move the inner box part downwardly into the outer box part and to finally provide positive pressure for moving the two part box parts into fully closed relation.

A still further object of the present invention is to provide such a means for vibrating and applying pressure to a filled box wherein the box is laterally held while the fruit is vibrated and wherein vibrations are imparted to the box through a bottom plate and where at one stage, resilient pressure is applied to the top of the vibrating box.

A still further object of the invention is to provide means for vibrating a filled box and applying closing pressures thereto wherein the pressure applying means includes two stages, a first stage for resiliently applying pressure to the inner box part in its raised position and a second stage in which the inner box part is positively pressed downwardly into fully telescoped relation with the outer box part.

A still further object of the invention is to provide a means for receiving a closed filled vibrated box and inverting the box for final distribution.

Generally speaking, the present invention contemplates a novel citrus packaging apparatus and method which is adapted to utilize standard boxes and which is adapted to vibrate the fruit in a box in such a manner that the fruit will seek a desired regular pattern and will be in tight packed relation when the filled box is exited from the apparatus. The invention contemplates an apparatus for tightly packing fruit so that during shipment there will be no damage to the fruit because of looseness in the pack and rolling in the box.

It will be understood that various other objects and advantages of the present invention will be readily apparent from the following description of the drawings in which an exemplary embodiment of the invention is disclosed.

IN THE DRAWINGS

FIGS. 7 and 7A are fragmentary views taken from the planes indicated by lines VII—VII of FIG. 6 and VIIa and VIIa of FIG. 6 showing an oscillating drive means and adjustment means for varying inclination of the delivery apron.

FIG. 8 is a sectional view taken in the vertical plane indicated by line VIII—VIII of FIG. 5.

FIG. 9 is a fragmentary sectional view taken in the vertical plane indicated by line IX—IX of FIG. 8, the view showing a fruit in counting position.

FIG. 10 is a fragmentary sectional view taken in the same plane as FIG. 9 and shows the fruit being raised and discharged onto a discharge apron for discharge into a box.

FIG. 11 is a perspective view of a loaded box with the box flaps of the inner box part in upstanding position and the counted fruit filling the box to a level so high that the flaps are not closable.

FIG. 12 is a fragmentary perspective view of a filled box as shown in FIG. 11 entering the box handling station B.

FIG. 13 is a fragmentary view taken in a transverse vertical plane at the inner box part lifting stage of the box handling station.

FIG. 14 is a fragmentary perspective view of a box positioned in the box handling station illustrating the tucking and folding of the box flaps into closed position.

FIG. 16 is a fragmentary side elevational view of the box vibrating and closing station C.

FIG. 17 is a fragmentary enlarged transverse sectional view taken in the plane indicated by line XIV—XIV of FIG. 16.

FIG. 18 is a fragmentary sectional view taken in the plane indicated by line XVIII—XVIII of FIG. 16.

FIG. 20 is a fragmentary enlarged view of a first pressure applying means for telescoping the inner box part into the outer box part while the box and fruit therein are vibrated.

FIG. 21 is a fragmentary enlarged view of the second pressure applying means for completely closing the telescoped inner and outer box parts.

FIG. 22 is a fragmentary side view of a box invertor, station D, at the exit end of the apparatus.

FIG. 23 is a perspective view of a filled box which has been inverted and with the top removed to show the tight packing of the fruit and uniformity of on the top layer thereof.

DETAILED DESCRIPTION OF THE INVENTION

Figure 1:
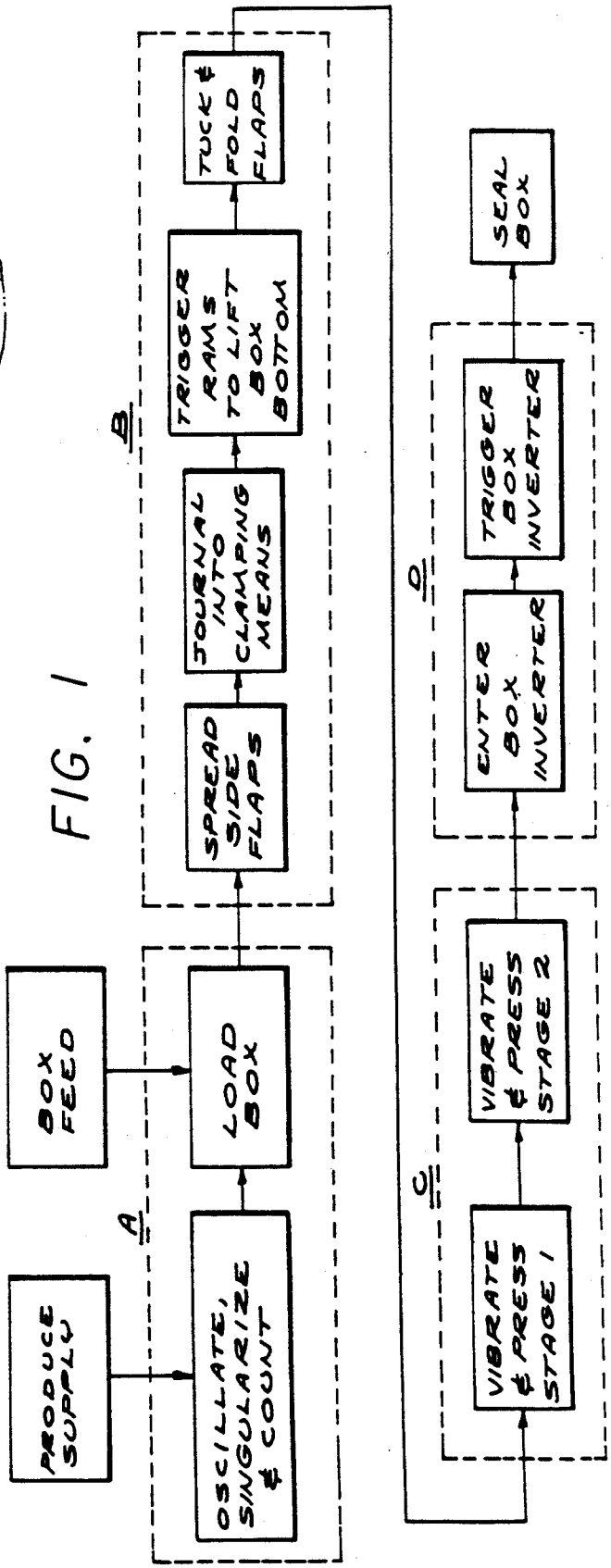
FIG. 1 is a schematic general view of the process steps embodied in the apparatus and method of this invention.
Figure 2:
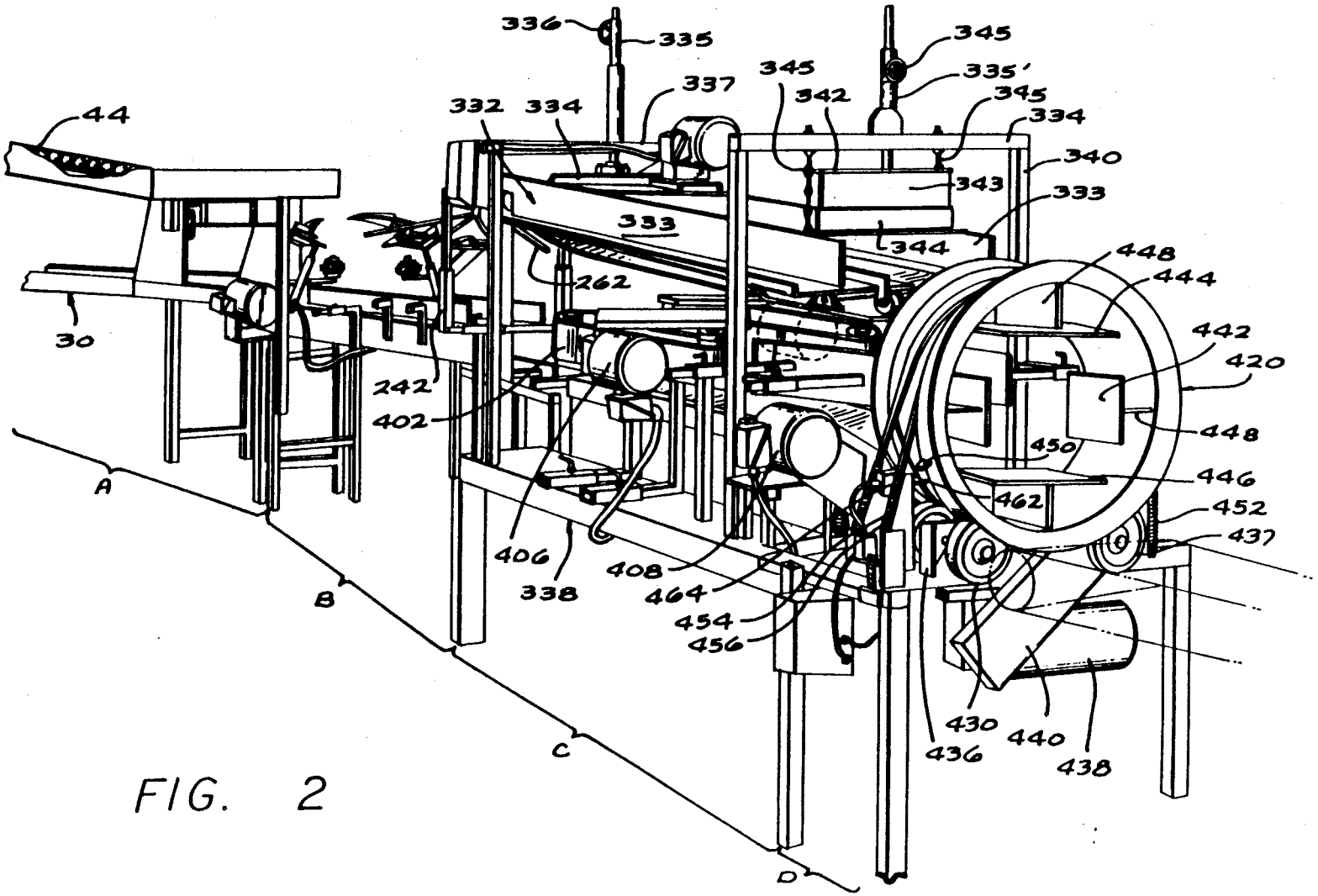
FIG. 2 is a perspective assembled view of an apparatus embodying this invention.
Figure 3:
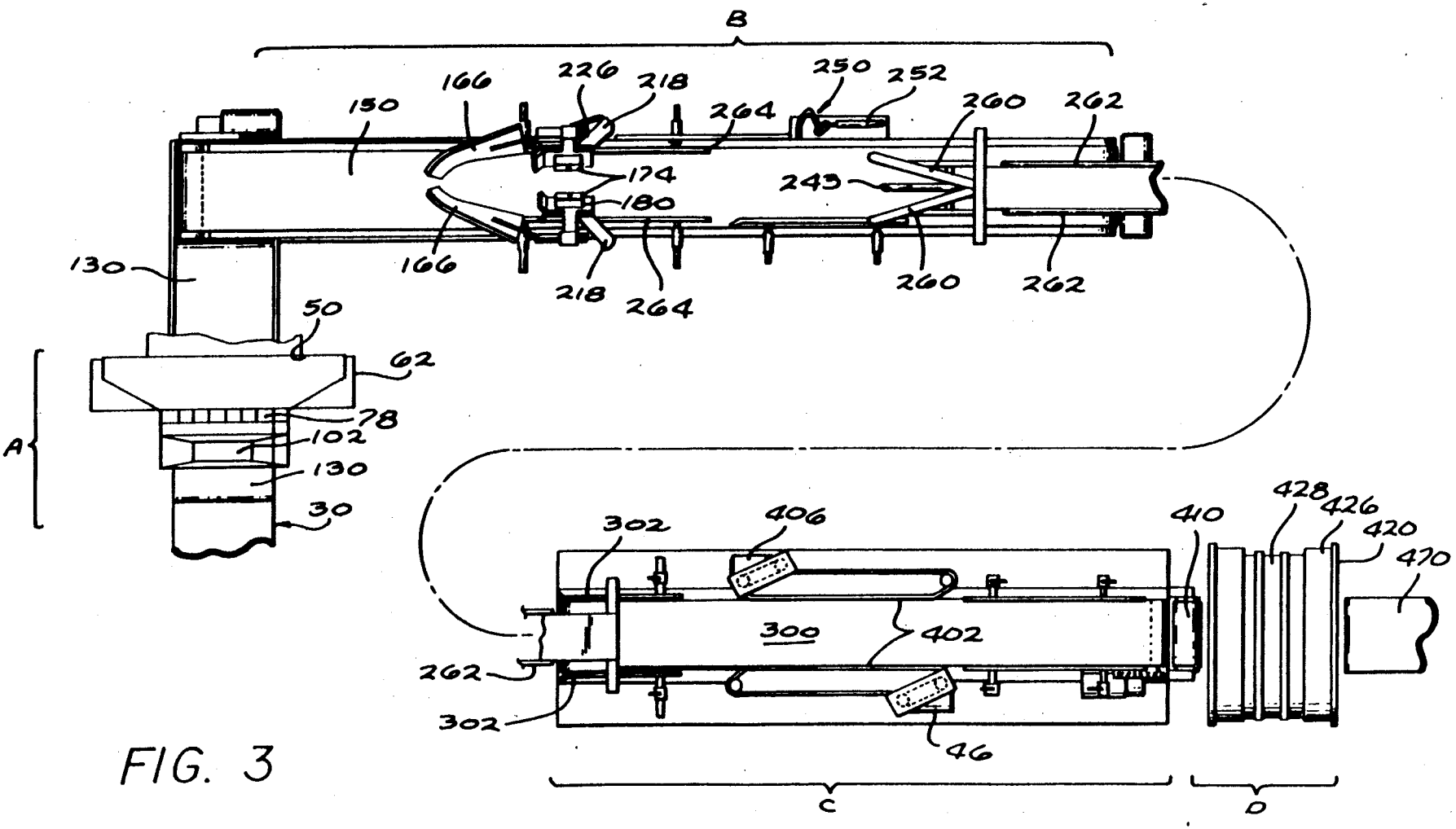
FIG. 3 is a schematic plan view of the apparatus shown in FIG. 2.

In FIGS. 1, 2 and 3, an apparatus embodying this invention is schematically illustrated. In these figures, the counting and box filling station is indicated by letter "A", the box handling station, which includes lifting of the inner box and folding of the inner box flaps, is indicated by "B", the box vibrating and pressure applying station is indicated by letter "C", and the box inverting station in which the box is turned over 180° is indicated by "D".

In FIGS. 2, 3, the box feed conveyor and the fruit feed conveyor are schematically illustrated and in various installations, the location and relationship of the direction of travel of the boxes and the fruit may vary.

A box feed conveyor is generally indicated at 30 and may include an endless conveyor belt 32 supported in well known manner from a frame and end rollers (only one roller being shown). At the entry end of box feed conveyor 30, a plurality of boxes 33 may be assembled, each box comprising an outer box part 34 (FIG. 11) in which the printing on the box is shown inverted or upside down since the box, when shipped and displayed, would normally be inverted as described hereinafter. The outer box part 34 includes bottom (top) flaps which are closed and sealed. The box 33 also includes an inner box part 36 which has side and end walls telescopically received within the outer box part 34 and which may extend for the same height as the side walls as outer box part 34. In FIG. 11, the inner box 36 is illustrated with upstanding end flaps 38 and side flaps 40. Such an arrangement of telescoped inner and outer boxes is well known in the industry.

A feed conveyor 44 for the fruit to be packaged in a box 33 may comprise any suitable article feed conveyor including a belt 46 onto which a supply of fruit may be fed from suitable conveyor means well known in the industry. The fruit is supplied in bulk and moves along the belt 46 to a box counting and filling station A. Fruit on belt 46 is discharged into the counting and box filling station at a selected rate of feed.

Counting and Box Filling Station—A

Figure 4:
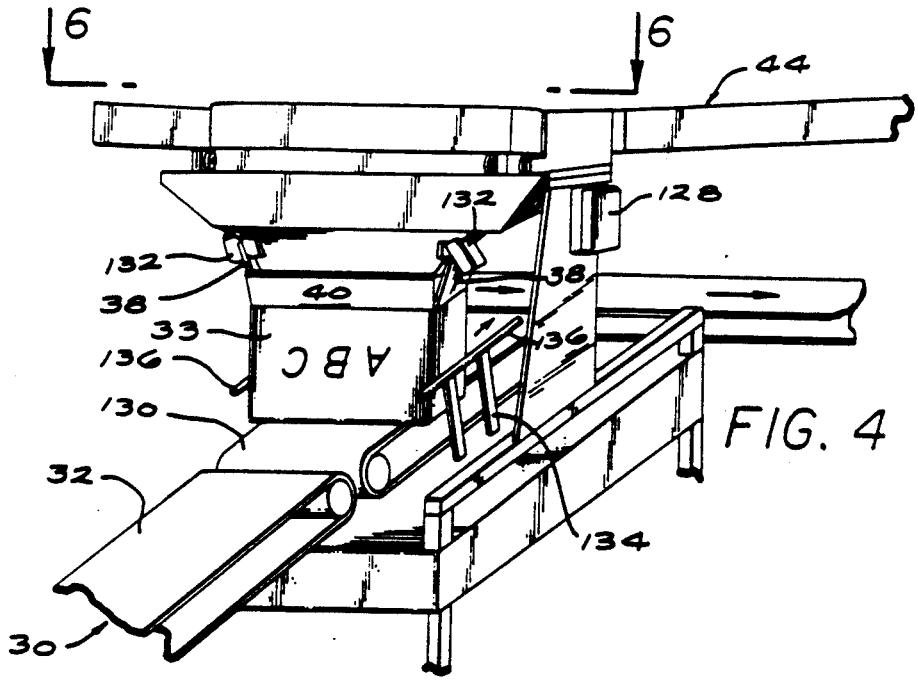
FIG. 4 is a fragmentary perspective view taken from the box feed conveyor as boxes are fed to the apparatus of FIG. 2.

The counting and box filling station is best shown in FIGS. 4–10 inclusive. In FIG. 4, fruit moving along the belt 46 enters a gate 50 defined by upstanding walls 52. Downstream of gate 50, a collection area for fruit is indicated at 54. Collection area 54 is defined by upstanding side walls 56 and converging side walls 58 which lead the fruit to a counting zone 60. Supporting the fruit at the collection area 54 may be an oscillatable adjustably inclined platform 62 which extends between the gate 50 and the counting zone 60 and which is inclined downwardly to direct the fruit to a valley 82 at the counting zone. Since fruit may tend to pile up in the fruit collecting zone 54, the platform 62 is oscillated transversely of the path of the fruit as indicated by arrow 64 in FIG. 5.

Figure 6:
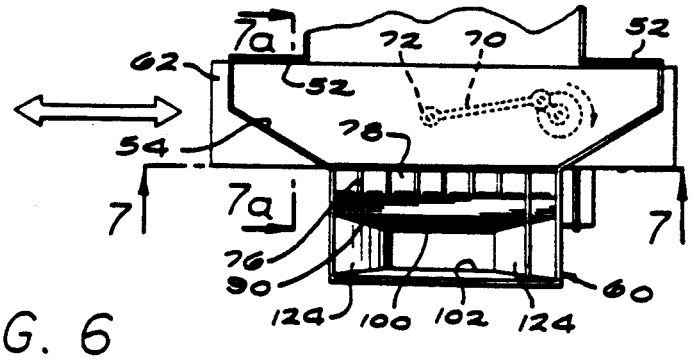
FIG. 6 is a fragmentary top view taken in the plane indicated by line VI—VI of FIG. 4 of the counting and filling station.
Figure 7:
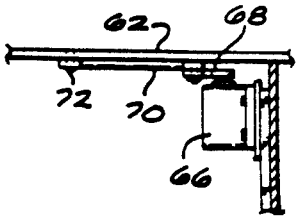

Means for transversely oscillating the platform 62 is shown in FIGS. 6, 7 and may comprise a motor 66 provided with an arm 68 attached to a link 70 pivotally connected at 72 to the bottom of platform 62. Rotation of the drive shaft of motor 66 will be transmitted into linear oscillating movement of platform 62 in order to impart lateral movement to the fruit in the collecting zone and to prevent bridging of the fruit which may result in improper feed of the fruit to the counting Means for adjusting the inclination of delivery apron or platform 62 may comprise a hinge means 65 which provides pivoting of the platform 62 with respect to the member 68. A crank handle 67 rotates a shaft 67a threaded in member 68 and has a shaft end bearing against the under surface of delivery platform 62 to raise or lower platform 62 about hinge means 66. A protective pad 67 to prevent scuffing of the fruit being delivered to the counting stalls may cover the oscillating platform 62 and part of the adjacent stationary apron in front of the stalls. The pad 67 may be of suitable material such as an ultra-high molecular weight thermoplastic polyethylene.

The counting zone 60 may comprise a plurality of equally spaced upstanding spacer plates 76. Spacer plates 76 are arranged in parallel and define a row of counting openings or stalls 78, each opening 78 being of pre-selected width to accept a fruit of selected size. The width of each opening 78 is sufficient to accept the largest size of fruit contemplated for the apparatus. It will also accept fruit of smaller size as long as the smaller size is not so small that two fruit may crowd into the opening 78. In this respect, it will be understood that fruit being counted by this apparatus will usually be pre-sized fruit and the size of the fruit being counted will be relatively uniform.

Fruit such as fruit 80, FIG. 9, oscillated by the platform 62 will drop into a counting valley indicated at 82, FIG. 9. Counting valley 82 is defined by the plurality of upstanding spacer plates 76 and by a transverse member 84 which carries the plates 76. Transverse member 84 is provided with a rather sharply inclined surface 86 which, as shown in FIG. 9, in its down position permits fruit 80 to roll from the oscillating plate 62 into the valley 82. The valley 82 is further defined by upstanding micro-switch members 90 is further defined by upstanding micro-switch members 90 which have a front surface 92 adapted to be contacted by a fruit 80 and a rear surface 94 attached to a microswitch element 96. In FIG. 9 a micro-switch 98 is located below an inclined discharge apron 100 which permits the fruit to fall into a discharge opening 102 leading to a box 33 positioned under opening 102.

The transverse member 84 extends for the width of the counting zone except for one counting space indicated at 104. Supported from a frame means 106 and by a lower transverse beam 108 may be a pair of spaced upstanding rams 110 which are connected by their piston rods 112 to transverse member 84 which carries the counting plates defining the counting stalls 78 as described above.

It will be readily apparent that in operation of the counting station, fruit 80, as shown in FIG. 9, will fall into the counting valley 82 and the weight of the fruit 80 will cause rearward movement of the hinged micro-switch element 96 to activate the micro-switch 98. When fruit 80 in each of the counting stalls 78 have been counted, the rams 110 are activated and the entire row of counted fruit is lifted upwardly, FIG. 10, so that the fruit may be discharged from the inclined surface 86 onto the inclined apron 100 for discharge into the opening 102 and to the box therebelow. As shown in FIG. 10, in raised position of the transverse member 84, the face 114 thereof serves to block and stop any fruit in the oscillating plate zone from entry into the counting stall. When the fruit 80 are discharged from the entire row, which occurs at essentially the same time, the rams 110 retract the transverse member 84 to its fruit receiving position shown in FIG. 9 and the next fruit from the oscillating plate 62 are urged into the row of counting stalls by the pressure of the following fruit which are being subjected to lateral oscillating forces of the downwardly inclined platform 62.

As mentioned above, at one end of the row of counting stations, there is provided a single counting station 104 (FIG. 8). Counting station 104 is similar to each of the row of counting stalls in that it is defined by an upstanding spacer plate 78 at one side and by a side wall 116 of the counting station frame. The micro-switch arrangement for counting at dribble station 104 is similar to that already described and the bottom of the dribble valley zone is defined by a member 118 which is connected to a rod 120 of a dribbler ram 122. When the total count of fruit required for the box is less than a multiple of the number of counting stalls in a row that are associated with the transverse member 84, the dribbler counting stall will accept a sufficient number of individual fruit and count such individual fruit until the selected fruit count is achieved. During operation of the dribbler counting stall, the row of counting stalls are activated. Thus, the total selected fruit count is discharged from the bulk collecting area 56 into the opening 102 and to the box 33 therebelow. As best seen in FIG. 6, opening 102 includes converging inclined end walls 124 leading to a box 33.

Figure 5:
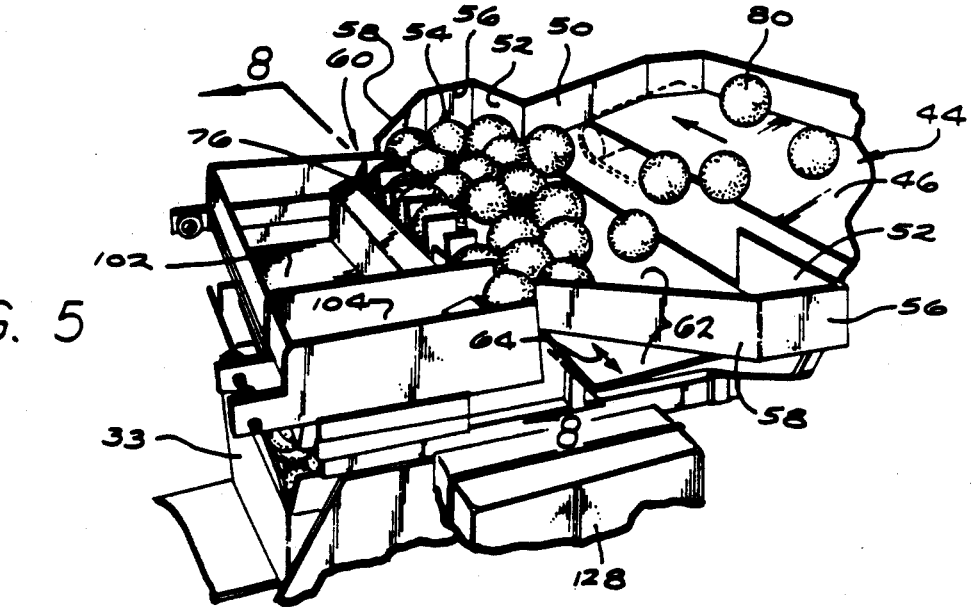
FIG. 5 is a fragmentary perspective view looking downwardly at the end of the feed conveyor and the counting and box loading station A.

As shown in FIG. 5, a control means 128 is generally illustrated to which the counted fruit in each station is relayed by the micro-switches 98, such control means 128 being set to determine the selected amount of fruit to be passed through the counting zone and into the box therebelow. Such a micro-switch activated control counting means is well known in the art.

In an example of counting control at the counting station, the count may be programmed to provide even and uneven total counts. There are shown seven main counting stalls and one dribble stall; a total of eight stalls. As shown below, to obtain a total count of 40, all eight stalls lift fruit therein five times. Even counts of 48, 56, 72, and 88 are obtained by lifting fruit in the eight stalls, 6, 7, 9, and 11 times respectively. Uneven or odd counts are obtained by programming the lift sequence of seven stalls and one dribble stall as indicated below for counts 113 to 235 as shown below. For example, the total count of 113 requires lifting fruit in the seven main stalls 15 times and lifting fruit in the dribble stall eight times. To obtain the odd count, the dribble stall is stopped early or before the seven main stalls have completed their sequence for the desired odd count. Other even and odd counts are exemplarily shown below.

| Count | Main | Dribble |
|---|---|---|
| 40 | 5 | 5 |
| 48 | 6 | 6 |
| 56 | 7 | 7 |
| 72 | 9 | 9 |
| 88 | 11 | 11 |
| 113 | 15 | 8 |
| 138 | 18 | 12 |
| 163 | 21 | 16 |
| 180 | 23 | 19 |
| 63 | 8 | 7 |
| 75 | 10 | 5 |
| 95 | 12 | 11 |
| 115 | 15 | 10 |
| 140 | 18 | 14 |
| 165 | 21 | 18 |
| 200 | 25 | 25 |
| 235 | 30 | 25 |

In FIG. 4, it will benoted that box 33 has been transferred from box feed conveyor means 30 onto a second conveyor means 130. When the box 33 is transferred to conveyor means 130, which is adapted to stop and position the box 33 immediately underneath box filling opening 102, the box 33 with end flaps 38 in upstanding inclined position are guided into flap guide means 132 in order to position and retain the end flaps in a non-obstructing position for the fall of fruit into the box. In addition, conveyor 130 includes end wall guide means 134 which may comprise longitudinally extending rails 136 for positively positioning the box 33 laterally of the box conveyor 130 and in alignment with the box feeding discharge opening 102. Not shown are means for stopping the conveyor 130 in the box filling station, such stopping means may include a pair of box sensors on opposite sides of conveyor means 130 which activate the box stop means by automatic control means and which are released when the box has received its full count. When the box has received its full count, the conveyor means 130 advances the box to the next station which is identified as a box handling station—B.

Box Handling Station—B

As best seen in FIG. 11, the filled box 33 includes fruit which is not arranged in a tight pack and loosely, randomly fills the box to a level which is too high to close the side and end box flaps. It should be further noted that the inner box part 36 is fully received within the outer box part 34. The purpose of the box handling station B is to lift the inner box part 36 relative to the outer box part 34 and to place the inner box part in a position where the end and side flaps 38 and 40 may be folded over by automatic means and closed before the fruit is vibrated into a compact arrangement within the box. Such operations are best shown in FIGS. 12, 13 and 14.

In FIG. 12, the box 33 has been transferred from conveyor 130 to a continuously moving conveyor means 150 which was arranged at 90° to conveyor 130 as generally indicated in FIG. 3.

In FIG. 12, the conveyor means 150 includes a frame 151 for supporting the conveyor belt and transversely of the conveyor frame is a box section transverse member 152 which at each side of the conveyor means supports a laterally adjustable square cross section beam 154. Beam 154 at its outboard end includes a vertically arranged sleeve of box cross section 156 which receives upstanding standard 158 which is vertically adjustable in sleeve 156 by a lock screw 160. Upright 158 supports adjacent its top a rearwardly extending beam 162 of box cross section which serves as a support for an arm 164 which at its rearwardly extending edge end carries a side flap guide 166. Flap guide 166 is relatively wide at its trailing end 168 and tapers to its free leading guide end 170 to a relatively narrow width. Side flap guide 166 throughout most of its length is arranged diagonally and rearwardly, FIG. 3, to the path of advancement of box 33 and at its leading end 170 is angled more transversely to the path of box 33 to assure contact with an upwardly inwardly inclined side flap 40 to guide such a side flap 40 into an outboard upwardly inclined position such as shown in FIG. 12. The purpose of the side guide flap 166 is to assure that the leading edge of side flap 40 will be so positioned diagonally outwardly of the box that it will be received between a pair of flap retaining jaw means comprising a bottom jaw 172 and a top jaw 174. Bottom jaw 172 has an inclined entrance apron 176 and upper jaw 174 has a rearwardly and outwardly flared inclined guide portion 178.

The top and bottom jaw means at each side of the conveyor serve to receive a side flap 40 as shown in FIG. 13. The top jaw 174 may be provided with a weight 180 attached to its upper surface to permit the jaw to be weighted to a downward position. Jaw 174 is hinged about a pivot 182 provided on a mounting plate 184 secured to the upright 158. The bottom jaw 172 is pivoted at 186 to a mounting plate 188 carried by the upright 158. Bottom jaw 172 is provided with a downwardly extending lug 190 which is pivotally attached at 192 to the upper end of a rod 194 of a fluid pressure actuated ram 196 which is pivotally attached at 198 to a member 200 connected to upright 158. In operation, when the side flaps 40 on both sides of the box have been guided between the top and bottom jaws and the box has reached a position as determined by a sensor means 202, which may comprise a photo-electric eye or a fiber optic sensing device, the rams 196 are actuated to cause the bottom jaw to rise upwardly engaging the side flaps 40 with the top jaw 174 and lifting the inner box part upwardly. Such upward lifting of the inner box is performed against the internal friction of the inner box sides within the outer box and the pressure of the randomly arranged fruit in the box. In order to hold the outer box in its position on the conveyor, means are provided for holding the outer box part on the conveyor while such lifting operation occurs.

Means for holding the outer box in such position on the conveyor 150 may comprise a pair of rotatable box gripping means 206 each of which comprises a pair of circular discs 208 between which are mounted an internal cylinder 210 which is provided with a plurality of radially outwardly extending pins 212. Pins 212 engage the side wall of the outer box part 34 as shown in FIG. 13 and hold the outer box against upward movement. The gripping means 206 may be supported on an upstanding spindle 214 which is carried by a member 216 supported on a bar 218 pivotally mounted about a pivot means 220 carried by upright 158. The pivot means 220 includes an arm 222 which extends toward the conveyor means and is attached to the bar 218 intermediate its ends. At the outboard end of arm 218 a connection 224 is made to one end of a biasing spring 226 which is connected at its other end at 228 to the upright 158. It will thus be apparent that when the upright 158 and the gripping means 206 are properly adjusted relatively to the path of a box on the conveyor means 150, the pins will be positioned to engage and lightly penetrate under the bias of springs 226 the surfaces of the side walls of the outer box so that the outer box will be held in its normal path on the conveyor means. Such engagement will be under sufficient pressure by the action of the spring means 226 to prevent lifting of the outer box part. Thus, as the box progresses in continuous movement along its path, the pressure wheel 206 engages the side wall of the outer box part 34 and holds the outer box 34 in position while only the inner box part 36 is being raised by the action of the rams 196.

The raised position of inner box part 36 is shown in FIG. 13 where it will be noticed that the side flaps 40 are turned outwardly and are still retained within the jaws and the end flaps 38 are also in an upward position. The top jaw is adjustably weighted so that as the box continuously moves forward on the conveyor means 150 the side flaps 40 may slide between the jaws without causing hesitation in the movement of the box in a forward direction.

In a second stage of the box handling means, the conveyor frame may include a pair of vertically adjustable upstanding standards 240, FIG. 14, which are supported from box section sockets 242 connected to a transverse frame member. The standards 240 support means for closing the leading end flap 38 and the side flaps 40. As shown in FIG. 14, a rearwardly downwardly and upwardly inclined rod 243 extends centrally from between the standards 240 toward an approaching box for contact with the upstanding leading end flap 38 and to press said end flap downwardly of the inner box part 36. This occurs as the box 33 continuously advances and before the side flaps are infolded.

Figure 15:
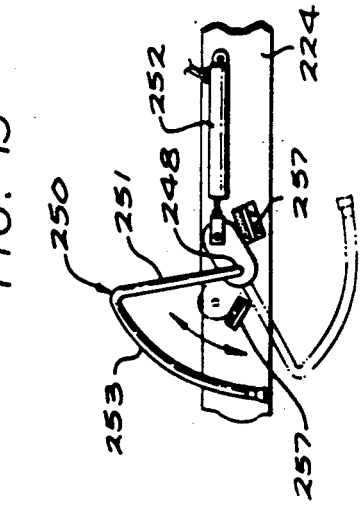
FIG. 15 is a fragmentary view of an end flap tucking means taken from the plane indicated by line XV—XV of FIG. 14.
Figure 19:
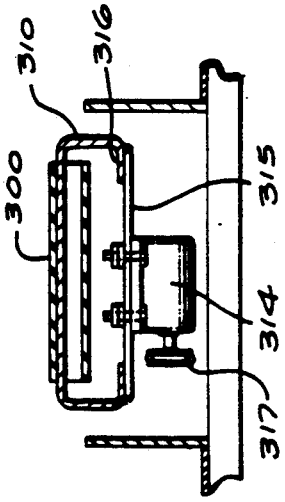
FIG. 19 is a fragmentary sectional view taken in the plane indicated by XIX—XIX of FIG. 16.

As the box 33 advances, at one side of the conveyor means, as shown in FIG. 15, a conveyor frame member 244 supports a mounting member 246 which provides pivotal support at 248 for a horizontally disposed tucking arm 250. Arm 250 includes a straight arm portion 251 and a curved arm portion 253 which joins arm portion 251 at an acute angle. Tucking arm 250 in one position, FIG. 15, lies to one side of the path of the box 33. When the box reaches a selected point in its advancement, tucking arm 250 is actuated by a fluid pressure means or ram 252 through a link 255 to swing arm 250 inboardly about its pivot point to overtake the box. Inward and outward swinging movement of link 255 is limited by stops 257. The free end of arm 250, which is provided with an enlargement 254, contacts the trailing end flap 38 of the advancing box 33. The rate of travel of the enlarged end 54 overtakes the trailing end flap 38 and pushes it inwardly over the fruit as can be seen from FIG. 14. Both end flaps 38 have now been infolded over the top layer of the fruit.

As the box 33 further advances in the second stage of the box handling means, the side flaps 40 are turned inwardly by a pair of converging side flap guide members 260 supported from standards 240. Members 260 are inclined downwardly so as to pass beneath the leading edges of the side flaps 40 as the leading end flap 38 is being infolded by rod 243. As the box continues to advance, guide members 260 lift and fold inwardly each of the side flaps 40 because of the inclined converging edges of the guide members 260 and also of the lower guide elements 261 which guide the side flaps into lower more closed relation.

When the box emerges from the box handling station, the closed side flaps are contacted by a pair of hold-down rods 262, FIG. 14, which prevent the side flaps and the end flaps from raising upwardly as the box conveyor means transports the box 33 to the next station C.

It will be noted that in the box handling station, the box 33 is transported on the conveyor belt 150 and that it is guided into a selected lateral position on said belt by guide means 264 (FIG. 12) each of which are provided with an inwardly converging end 266 to facilitate lateral movement of the box relative to the conveyor belt. The side guides 264 may be biased inwardly by spring means 268 carried on a rod 270 which is supported from a cylinder 272 carried on a frame member 274.

Box guide members 273, FIG. 14, may be likewise provided at the flap closing stage, each guide member 273 having outwardly flared ends 275 for directing the box to a desired lateral position on the conveyor and for alignment with the end and side flap closing means.

The Box Vibrating and Pressure Applying Station C

The box vibrating and pressure applying station is best shown in FIGS. 16 to 21. In FIG. 16, a box 33 may be entering the vibrating station at the left of the figure after departing conveyor 150 and moving onto an endless conveyor 300 which will convey the box through the box vibrating and pressure applying station C. The frame means at the entry to this station may include a pair of spaced side guides 302 which facilitate the transition of the box into the pressure applying station and assures that the box is longitudinally aligned with the conveyor belt.

The conveyor belt means 300 extends to the exit end of station C and its upper lay 304 extends over an elongated rectangular table 306 which is resiliently mounted for imparting vertical and lateral vibrations to a box. As best seen in FIGS. 17 and 18, the table 306 comprises a top plate 308 over which the upper lay of the belt extends and includes downwardly and inwardly turned side members 310 which provide a connection at opposite ends of the table 306 to laterally spaced pairs of cone-shaped resilient coil springs 312. The coil springs 312 are of unique design and permit the imparting to table 306 of vertical vibrations and limited lateral and longitudinal vibrations.

A vibrating means is provided at each end of table 306. Each vibrating means includes a motor means 314, FIG. 19, carried by a transverse member 315 attached to inturned flanges 316 of side members 310 of the table. Motor 314 drives a pulley 317 connected to a pulley belt 318 which is connected at its other end to a pulley 319 carried by a rotatable cross shaft 320 also supported from flanges 316 from mounting blocks 321. Shaft 320 carries an eccentric adjustable weight 322 which is laterally offset from the center line of the table. The shafts 320 at opposite ends of the table may be rotated in opposite directions to cause a desired complex vibration of the vibrating table 306. The motor means 314 may be driven at a selected rotational speed in order to obtain such a desired vibrational effect. The combination of offset eccentric weights 322 mounted upon cross shafts 320 driven in opposite directions at selected speeds, together with the cone-shaped design of the mounting springs 312 for the table, results in a vibrational effect on the table and on the box supported thereby which includes not only vertical but also lateral and longitudinal vibrations.

As a result, when a box enters station C and begins to move on the conveyor 304 the loose fruit are vibrated in three dimensions and a fluid state of the fruit is created which causes the fruit to begin to settle into close compacted relation.

In FIG. 16, a box which has entered station C is beginning to have the inner box part moved downwardly into the outer box part by the inclination of the guide rods 262. As the box approaches the entrance end of station C with the top flaps of the inner box part held in closed relation by the guide rods 262, the box enters a passageway in station C which progressively decreases in height. This change in height of the passageway is provided by an inverted conveyor means 332 which includes spaced upper longitudinally extending inclined pair of rails 333. At the entrance end of the passageway, the longitudinal conveyor 332 may be supported by a cross member 334 connected to the lower end of an adjustable jack 335 provided with a suitable adjustment wheel 336. Jack 335 is supported from a cross member 337 of the station frame means generally indicated at 338.

At the exit end of station C, the inverted conveyor 332 is supported by a similar adjustable jack means 335' carried by a cross member 339 supported from the frame uprights 340 of the station frame 338. The jack 335' includes an adjustable wheel 341 and is connected to a cross member 332 which is connected through a flexible means 343 to a cross member 344 which is secured to upper edges of rails 333. A selected minimum height for the exit end of upper inverted conveyor 332 is provided by a pair of flexible chains 345 which limit the flexible means 343 permits the exit end of member 332 to adjustably variably ride upwardly from the minimum selected height as a box progresses through the exit end of a passageway and provides for limited vertical play of the member 332 as downward pressure is applied to the top of the box as later described.

The top conveyor belt 330, which includes a bottom lay 331, extends to the exit end of member 332 and passes around an end roller 350. It will be noted that the bottom lay 331 of the endless conveyor belt 330 has some slack as it moves from the entrance end of the passageway to a mediate portion of the passageway in order to provide initial contact with the top of a box at the early entry portion of the box into station C. The downward inclination of the bottom lay 331 guides the folded end flaps of the inner box path to the first pressure applying means.

As best seen in FIG. 20, a first pressure applying means includes a longitudinally extending panel member 366 which, at the box entry end, may be upwardly inclined at 368. The width of member 366 may be approximately that of the bottom lay 331 of the top conveyor belt 330. The bottom surfaces of the pressure applying member 366 may be provided with an anti-friction surface material 370 to facilitate passage in sliding relation of the bottom lay 331 and the folded flaps of the inner box part therebeneath. Pressure applying member 366 is connected at its other end to a hinge 372 carried by a transverse member 374 connected as by welding to one end of an elongated longitudinally extending bar 378. Bar 378 generally parallels member 366 and may be connected at its other end by a hinge 382 to an attachment bracket 384 carried between the rails 333 of the member 332. Pressure applying bar 366 is biased downwardly against the bottom lay 331 of the top conveyor belt by a pair of spaced coil springs 386 and by a relatively closely coiled front helical spring 388 located adjacent hinge 382. The helical spring 388 provides relatively stiff resilient resistance to a box passing therebeneath in order to initiate positive movement of the inner box part into the outer box part and to apply pressure through the folded end flaps to the underlying fruit which is in a fluid state in the box. The relatively softer coil springs 386 permit continuation of such pressure against the top of the box but at the same time permits some vertical yieldability to further facilitate settling of the fruit in the box.

At the second pressure applying stage, FIG. 21, the longitudinally extending top member 332 is provided with a pressure applying member 390 which bears against the bottom lay 331 of the top belt 330. The second pressure applying member 390 is provided with a pivot connection at 392 intermediate the ends of the member 390. Pivot connection 392 is carried by a downwardly and rearwardly inclined member 394 which is rigidly attached at 395 to the top member 332. The leading end of pressure applying member 390 includes an upwardly inclined end portion 396 which carries a freely rotatable wheel 398 which bears against the undersurface of the rails 333 of the top member 332. In the second pressure applying stage, pressure member 390 is not resiliently mounted but is adapted to pivot intermediate its ends at pivotal connection 392. Member 390 is slightly inclined relative to the bottom conveyor and at the exit end of station C is spaced at its rear edge 400 a selected distance above the top lay of the bottom conveyor 300, such distance being the space desired for the vertical dimension of a completely closed box. Thus, at the exit end of station C, the inner box part has been fully telescoped within the outer box part and the end flaps are in full closed position.

When a box 33 passes side guide plates 302 at the entrance to station C, the box is propelled not only by the top lay of the bottom conveyor 300, but also by parallel side belts 402 having inboard lays travelling in the direction of the advancement of the box. Thus, as the box progresses through station C, the box is firmly held against lateral movement by the inboard lays of the side belts 402. A box is subjected to both downward resilient pressures by the top conveyor belt 330 and upwardly acting vibratory impulses and pressures from the top lay of the bottom conveyor belt 300 which is subject to vibration by vibratory means 314. As top conveyor belt 330 passes beneath the pressure applying stations 1 and 2 and with the sides of the box being held against sidewise expansion by the side belts 402 and with the fruit in a fluid state within the box and subjected to complex three dimensional vibrations and opposed resilient vertical forces, the inner box part will be telescoped downwardly into the outer box part as the fruit seeks its ultimate tightly packed relation.

To further facilitate movement of boxes through the passageway at Station C, the box contacting surfaces of the top and bottom conveyor belts and the side belts may include roughened surfaces to inhibit slippage between boxes and belts when pressure is applied to the boxes.

The pulley connections between the several abovementioned motor means and their respective conveyor belts are schematically illustrated only. The rate of travel of the belts are synchronized so that the box will be advanced at a selected uniform speed by the several conveyor belts. While the above description refers to a single box, in operation a plurality of boxes are advanced on the several conveyor means in. close back to front relation.

Box Inverting Means—Station D

When a box 33 exits station C, it is passed into a box inverting means D. At the transition from the bottom conveyor 300 to the box inverting means, a roller 416 may be provided supported from the frame in suitable manner and of relatively large diameter so that a box leaving the upper lay of the conveyor belt 300 will be pass horizontally over the gap between the end of conveyor 300 and the box inverting means D. Roller 416 is indicated in FIG. 3 and FIG. 17.

The box inverting means is for the purpose of turning the box through 180° and into upright position. In upright position, when the outer box part is removed for display of fruit, the top layer thereof will have a uniform tightly packed appearance as shown in FIG. 23.

The box inverting means may comprise a rotatable drum 420 of selected inner diameter, FIGS. 2 and 22. At opposite end portions of drum 420, are provided circular angle-section rail members 424 which may be welded to the outer circumference of the drum end portions and which provide track means. At the bottom of drum 420 and supported from adjacent frame members are provided two sets of spaced wheels 430, each set being supported from an axle 432 supported by uprights 434 carried by frame member 436. A motor means 438 may drive one of the spaced sets of wheels 430 at a selected rate of speed through a pulley connection schematically illustrated at 440, FIG. 2. The rotatable drum 420 is held on the sets of wheels 430 under pressure by a pair of straps 450 which anti-frictionally engage the upper cylindrical portion of the drum. One end 452 of each strap may tangentially depart in vertical relation from the circumference of the drum for connection to a frame member. At the opposite side of the rotatable drum an end 454 of each strap may be connected to one end of a coil spring having its other end connected to a frame member. The straps 450 may include suitable turnbuckles in order to resiliently tension said straps so as to provide a selected resilient pressure on the rotatable drum to hold the drum in proper position on the sets of wheels.

The straps 450 may be made of suitable material having an anti-friction slippery surface which engages the outer cylindrical surface of drum 420. An example of such material is an ultra-high molecular weight thermoplastic polyethylene.

Internally of drum 420 a box opening of selected size is provided by opposed rectangular side plates 442 and top and bottom rectangular plates 444 and 446. Each of the plates 442, 444 and 446 may be supported from the internal cylindrical surface of the drum by diametrically arranged internal webs 448. The opening provided by the rectangular plates 442, 444 and 446 receives a box with loose tolerance. The longitudinal dimension of the plates is substantially less than the axial dimension of the cylindrical drum for a purpose hereafter described.

As mentioned above, when a plurality of boxes are being subjected to vibration in the vibrating and pressure applying station C, as the boxes reach the exit end of station C they are in close back to back or back to front relation. The conveyor belts of the station C continue to advance the boxes and as a box reaches the exit end of the passageway of the station C, a box is pushed from the conveyor 300 into the box invertor station D and between the box holding plates 442, 444, and 446. Rotation of the drum 420 is synchronized with the belt and the plates 442–446 are in position to receive a box. The box is pushed into the box opening defined by such plates and as soon as it departs, the conveyor 300 and the transfer roller 410 the drum 420 commences rotation through 180°. Even while the box is in the drum 420, the succeeding box in its close relation to the box in the drum may have end wall contact therewith because of the shortness of the longitudinal dimension of the plates 442–446. In other words, the leading portion of the following box may partially enter the drum 420 during rotation of the drum 420 through 180°. At the end of the 180° turn, trigger 460, which is carried by a rail 426, contacts switch element 462 carried by switch means 464 to stop further rotation of the drum for, in effect, a momentary pause. At the pause at the end of the 180° turn, the succeeding box and other succeeding boxes on conveyor 300 continue to push the box that has been turned 180° out of the box inverting station onto the conveyor 470 for further transfer of the box. Rotation of the drum is timed with the conveyor belt 300 so that after the pause and the turned box has departed from the edges of the box retaining plates 442–446, the following box has already entered the opening defined by such plates and the drum is rotated through 180° to invert the following box.

Thus, boxes are successively pushed into the box inverting station, a box is rotated 180° therein and is pushed from the box inverting station onto conveyor 470 which then conveys the box to a box sealing station or other suitable destination. Thus, there is a continuous flow of boxes through the box inverting station with only momentary pauses of rotation of the drum in the same direction while a box is pushed from the box inverting station.

In the apparatus and method of the invention described above, it will be readily apparent that a novel arrangement for counting a plurality of discrete fruit has been provided at station A in that the fruit are urged into a plurality of stalls arranged in a row and in a valley and that when the row count has been met, the fruit are lifted and discharged into a box which has been inverted so that the first fruit in the box will become the top fruit layers of the box when it is turned 180° at the box invertor station D. When a precise count has been made and the selected number of fruit are in the box, the box is conveyed to a box handling station B where the inner box must be lifted and raised relative to the outer box in order that the side and end flaps of the inner box part may be folded over and closed. Such raising of the box is performed at station B where the side flaps are engaged by lifting means comprising side flap retaining jaws on opposite sides of the conveyor and the inner box part lifted to a selected height which will permit the infolding of the side and end flaps. Infolding of the side and end flaps is performed at a second stage in the box handling station B where the end flaps are first infolded and then the side flaps are infolded by the converging side flap guides as described above.

With the box having its inner box part in raised position and with the side and end flaps of the inner box part closed, the box is conveyed to the station C at which the fruit are vibrated to a fluid state and pressure is applied to the end flaps and side flaps of the inner box part in order to press the inner box part into the outer box part and to also apply pressure to the fruit therein so that it will seek its most compact relation within the box. At station C, the box and the fruit therein are subjected to vibrations which include vertical, lateral, and longitudinal imposed vibrational forces. Vertical forces are opposed by a resilient downwardly acting force at the pressure applying stage 1 and later by a firm relatively unyielding force applied by the pressure applying stage 2. While these forces are being applied to the filled box, the sides of the box are held against expansion sidewardly by side conveyor belts 402. As a result of the vibratory effect on the fruit in the box and the closure of the inner box part into the outer box part as described above, the fruit are packed in such close tightly packed relation that the use of a standard box size such as used for hand packing the fruit may be used.

It should be noted by those skilled in the art that the box inverting means described above is adapted to receive a box at one end of the cylindrical drum and to turn the box through 180° as the box progresses through the drum and is pushed by the box immediately following the box in the drum. As the box exits the drum, it has been turned 180°. Such a box inverting means is not only useful for the purpose described above, but is also useful in providing a box inverting dumping means in which filled boxes may enter the box inverter and be rotated through 180° and as the box exits the rotatable drum, may dump its contents onto a conveyor (not shown) located at the exit end of the box inverter.

It will be readily apparent to those skilled in the art that various modifications and changes may be made in the apparatus and method of this invention as described above and all such changes and modifications coming within the spirit of the invention and within the scope of the appended claims are embraced thereby.

We claim:

1. An apparatus for tightly packing a plurality of discrete articles in a box having outer and inner telescoped box parts and in which the inner box part extends above the outer box part with end and side flaps inwardly folded over articles in the box, the combination of:

a frame means;

a longitudinally extending table supported form the frame means;

resilient means supporting opposite ends of the table from the frame;

a bottom conveyor belt having an upper lay on the upper surface of the table for receiving a box filled with articles and closed with inwardly folded end and side flaps;

means on the frame cooperable with the resiliently supported table for vibrating the table;

an upper elongated member supported from the frame in spaced relation to the upper lay of the belt on the table;

an endless upper conveyor belt supported on the upper member and having a bottom lay extending longitudinally above the upper lay of the bottom conveyor belt;

means carried by the upper elongated member for applying resilient downward pressure on the closed box to cause the inner box part to move downwardly within the outer box part;

the bottom lay of the upper conveyor belt being disposed at the exit end of the frame means in such spaced relation to the upper lay of the lower conveyor belt to cause complete closing of the inner box part within the outer box part;

whereby said vibrating table and the imposition of oppositely directed resilient pressures to the box causes the fruit to settle and become tightly arranged within the box.

2. An apparatus as claimed in claim 1 wherein said upper elongated member and the pressure applying means includes an first pressure applying device having a fixed attachment at one end to said upper member and a pressure applying panel resiliently biased downwardly from said upper member.

3. An apparatus as claimed in claim 2 wherein said pressure applying means also includes a second pressure applying means including a pivot means attached to said upper member and a longitudinally extending member carried by said pivot means and spaced a selected distance below said upper member.

4. An apparatus as claimed in claim 1 including means for adjusting the height of said upper member at the exit end of said apparatus.

5. An apparatus as claimed in claim 4 wherein said adjustment means includes a plurality of chains;

a frame member carrying said chains above the upper member, and means for adjustably attaching said chains to said upper member for varying the height of said second pressure applying means to accommodate boxes of different height and to fully telescope said box parts.

6. An apparatus for tightly packing a box with a plurality of fruit in a selected pattern comprising in combination:

means including upper and lower conveyor belt means defining a passageway diminishing in height from the entry end of said passageway to the exit end of said passageway;

means adjacent the lower conveyor belt for resiliently vibrating the upper lay of said lower conveyor belt;

means adjacent the upper conveyor belt for progressively applying pressure to the lower lay of said upper conveyor belt for transmittal of pressure to the upper portion of a box passing through said passageway;

said pressure applying means including a first stage for resiliently reacting to said vibrations of the lower conveyor belt to facilitate compacting of the assembly of fruit within the box;

said pressure applying means including a second stage having a pivoted non-resilient pressure applying member downwardly inclined with respect to the lower conveyor belt to determine the final closed position of the inner box part with the outer box part.

7. An apparatus as claimed in claim 6 wherein said upper conveyor belt means is pivoted at one end and is adjustable heightwise at the other end for accommodating variations in different box heights.

8. An apparatus as claimed in claim 6 including endless side drive belts on opposite sides of said passageway, the inboard lays of said side drive belts being engageable with the sides of a box passing through said passageway for restricting lateral distortion of the box.

9. An apparatus as claimed in claim 6 including means for driving said upper and lower conveyor belts and said side drive belts at the same lineal rate of travel for facilitating movement of a box along said passageway to the exit end of said apparatus.

* * * * *